United States Patent [19]

Holland et al.

[11] 4,343,693

[45] Aug. 10, 1982

[54] METHOD OF REMOVING CONTAMINANT FROM A FEEDSTOCK STREAM

[75] Inventor: Eric O. Holland, Borger, Tx., Marvin M. Johnson, Bartlesville, Okla.

[73] Assignee: Phillips Petroleum Company, Bartlesville, Okla.

[21] Appl. No.: 249,548

[22] Filed: Mar. 31, 1981

Related U.S. Application Data

[62] Division of Ser. No. 80,600, Oct. 1, 1979, Pat. No. 4,269,694.

[51] Int. Cl.[3] ..... C10G 25/05; C10G 29/04

[52] U.S. Cl. ..... 208/244; 208/307; 208/211; 208/254 R

[58] Field of Search ..... 208/307, 244, 211, 254 R

[56] References Cited

U.S. PATENT DOCUMENTS

| | | | |
|---|---|---|---|
| 1,404,294 | 1/1922 | Hood | 208/244 |
| 2,384,315 | 9/1945 | Kuhl | 208/254 R |
| 2,687,985 | 8/1954 | Porter et al. | 208/211 |
| 3,761,539 | 9/1973 | Drehman et al. | 585/660 |
| 3,925,193 | 12/1975 | Constantikes et al. | 208/91 |
| 4,033,861 | 7/1977 | Holloway et al. | 208/211 |
| 4,176,047 | 11/1979 | Orrell et al. | 208/51 |

FOREIGN PATENT DOCUMENTS

| | | | |
|---|---|---|---|
| 486599 | 9/1952 | Canada | 208/244 |
| 730562 | 9/1952 | United Kingdom | 208/211 |

*Primary Examiner*—Delbert E. Gantz
*Assistant Examiner*—Helane E. Maull

[57] ABSTRACT

Contaminants such as petroleum sulfonates, anticorrosion amines, and silicone oils are removed from a contaminated feedstock stream by contacting said feedstock stream with an adsorbent comprising bauxite. In a further aspect, a thus purified petroleum feedstock stream is hydrodesulfurized.

10 Claims, 1 Drawing Figure

METHOD OF REMOVING CONTAMINANT FROM A FEEDSTOCK STREAM

Figure 1:
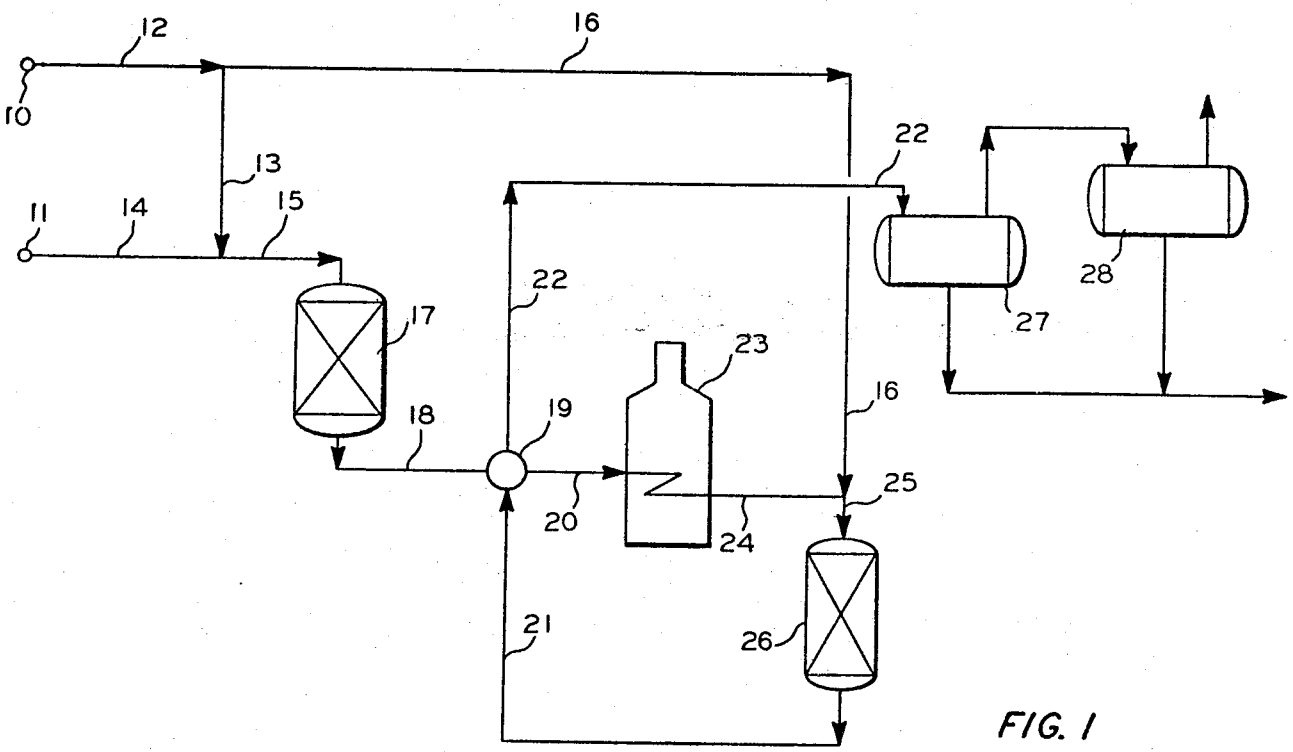

This application is a division of application Ser. No. 080,600, filed Oct. 1, 1979, now U.S. Pat. No. 4,269,694.

The invention relates to removing contaminants from a feedstock stream. In one of its aspects, the invention relates to removing contaminants from a feedstock stream to a hydrodesulfurization process. In another of its aspects the invention relates to contacting hydrocarbons containing contaminants with an adsorbent comprising bauxite.

A problem encountered in processing a feedstock stream such as for example, petroleum liquids received in a processing center, such as a refinery, from field production is the removal of materials which can foul equipment or otherwise interfere with subsequent handling and conversion steps such as catalytic conversions. Procedures to remove such materials as water, sediments, and entrained solids are well known.

Recently, however, the increased utilization of petroleum steams from enhanced oil recovery operations or tertiary recovery operations has given rise to additional problems of this nature resulting from the presence of chemicals used in such recovery procedures which persist in feedstock streams derived from the thus-recovered oil. As used herein, the term "feedstock stream contaminants" will be used to designate materials which can come out of solution, for example, heat exchanger surfaces, and onto the surfaces of solid particles, for example, catalysts. The feedstock stream contaminants can include, for example, enhanced oil recovery chemicals, for example, surfactants such as petroleum sulfonates, corrosion inhibitors such as amines, and antifoam agents such as silicone oil and the like which are added to counteract the foaming tendency created by surfactants and/or corrosion inhibitors. However, the term "feedstock stream contaminants" as thus defined is not limited to such contaminants which have as their ultimate source the fact that the chemicals were added in the course of enhanced oil recovery operations. Rather, the term "feedstock stream contaminants" refers to deposit forming contaminants in feedstock streams without regard to the manner in which the chemicals came to be present in the feedstock.

These contaminants can form deposits which cause fouling and plugging in heat exchange equipment and result in loss of catalytic activity in catalyst beds such as, for example, in fixed bed catalyst systems such as used in desulfurization, denitrification, isomerization, hydroprocesses such as hydrodesulfurization and the like.

Further while the invention is visualized to be particularly useful with petroleum containing feedstock streams, the term "feedstock stream" is intended to cover not only petroleum containing feedstock streams, but any feedstock stream containing deposit forming contaminants which can be removed employing the present invention.

Accordingly an object of this invention is the treatment of a contaminated feedstock stream to remove deposit forming contaminants. Another object of this invention is the treatment of a contaminated feedstock stream containing contaminants such as surfactants, corrosion inhibitors, and antifoam agents to remove such contaminants. Another object is a method for treating a contaminated feedstock stream serving as a feedstock stream for a hydrodesulfurization process to remove contaminants therefrom. Yet another object is the removal of contaminants such as petroleum sulfonates, corrosion inhibitors, and antifoam agents from petroleum feedstock streams derived from enhanced oil recovery or tertiary oil recovery processes. Yet other objects and advantages of this invention will be apparent to one skilled in the art from the following description and the drawing.

According to this invention, a contaminated feedstock stream containing contaminants such as surfactants, corrosion inhibitors, and antifoam agents is contacted with an adsorbent comprising bauxite to remove said contaminants therefrom to form a purified stream lean in such contaminants.

In a further aspect, such a purified feedstock stream lean in feedstock contaminants is contacted with a hydrodesulfurization catalyst to produce a hydrosulfurized feedstream for further processing as is known in the art.

FIG. 1 is a schematic representation of a preferred embodiment of the instant invention.

Referring now to FIG. 1 in detail, reference numeral 12 designates a reformer hydrogen stream having source 10, a portion of which is combined via stream 13 with a natural gas liquids (NGL) refinery stream 14 having source 11 comprising, for example, $C_5$ to $C_{10}$ hydrocarbons and passed with the NGL stream via a common stream 15 to a contacting bed 17 comprising bauxite. Stream 15 is contacted with the bauxite in bed 17 to remove at least a portion of contaminants such as, for example, corrosion inhibitors, surfactants, and antifoam agents therefrom to produce a purified stream 18 which is passed to a heat exchanger 19. In heat exchanger 19, stream 18 is in heat exchange relationship with a heating stream, for example, a hydrodesulfurized stream 21 from a hydrosulfurization reactor 26 whereby stream 18 gains heat to form a first heated purified NGL stream 20 and stream 21 is cooled to form a cooled hydrodesulfurized stream 22. Preferably stream 20 is heated as is known in the art to a temperature in the range of about 200° F. to about 500° F. Stream 20 is further heated in a furnace 23 if required to have a temperature in the range of about 400° F. to about 700° F., more preferably in the range of about 480° F. to about 650° F., since this is a normal range of hydrodesulfurization, so that a second heated purified NGL stream 24 is produced which is then combined with a portion of reformer hydrogen stream 16 and charged to a hydrodesulfurization (HDS) reactor 26 via common stream 25. In reactor 26, combined stream 25 is contacted with a suitable HDS (hydrodesulfurization) catalyst system, for example, a nickel molybdenum catalyst such as Nalco NM 502, available from Nalco Chemical Corp., Oakbrook, Ill., or the like to produce a hydrodesulfurized feedstock stream 21. Stream 21, as indicated above, is charged as a heating stream to economizer or heat exchanger 19 to produce a first cooled hydrodesulfurized stream 22. Stream 22 is then further processed as known in the art of petroleum refining such as in first and second flash tanks 27 and 28 respectively and further processed (not shown).

Although the present invention is illustrated in a preferred embodiment in which the adsorbent bed comprising bauxite is in the process stream of a hydrodesulfurization reactor, it is apparent that the invention is not limited thereto. Rather the invention is applicable to any system wherein deposit forming contaminants, for example, corrosion inhibitors, surfactants, and antifoam agents can cause a problem such as a problem with downstream equipment because of plugging or fouling of equipment or catalyst systems. The feedstock contaminants can be corrosion inhibitors such as amines and the like, surfactants such as petroleum sulfonates and the like, and antifoam agents such as silicone oils and the like. Further the invention is not considered limited to fixed bed hydrodesulfurization catalysts, although the invention is particularly applicable for use with such a catalyst system. Rather, the invention is applicable to the treatment of all process feedstock streams wherein a feedstock stream is contaminated such as for example with the above-specified deposit forming contaminants. Further such a feedstock stream lean in contaminants can be converted by contacting with a catalyst system. Such catalyst systems can include, for example, any of the many fixed bed catalyst systems known in the art for hydrodesulfurization, of which nickel-molybdenum and cobalt-molybdenum catalysts are most effective, as well as for example fixed bed catalyst systems utilized in other processes such as desulfurization, dinitrification, isomerization, hydroprocessing, and the like.

The hydrodesulfurization catalysts which can be used in the instant invention include any catalyst effective to catalyze the hydrodesulfurization of a hydrocarbon feedstock stream. Specific hydrodesulfurization catalysts can include those which contain catalytically active metals selected from molybdenum, tungsten, nickel, cobalt, copper, iron, zinc, and mixtures thereof. These elements can be present in the metallic state or in the form of oxides, or carbonyls, or sulfides, or salts of carboxylic acids such as naphthenic acids, or chemically combined with each other, or chemically or physically combined with other metals such as the alkali or alkaline earth metals, particularly barium. Some examples of these include molybdenum oxide, cobalt molybdate, nickel sulfide, zinc molybdate, copper oxide, barium oxide, copper molybdate, magnesium tungstate, iron oxide, barium molybdate, tungsten oxide, zinc sulfide, molybdenum hexacarbonyl cobalt oxide, cobalt naphthenate, nickel naphthenate, barium naphthenate, and the like and mixtures of any two or more thereof.

Such catalytically active materials can be associated, if desired, with catalytic support materials, preferably of the non-acidic type, such as alumina, calcium aluminate, barium aluminate, magnesium aluminate, bauxite, and the like and mixtures thereof. When such support materials are present, they can be present in any suitable amount, but generally the catalytic support materials can constitute from 40 to about 95 weight percent of the total catalyst composite.

In some instances, the catalysts, either supported or unsupported, can be associated with an effective amount of alkali metals or alkaline earth metals to minimize or eliminate acid sites which would otherwise promote cracking side reactions. Alkali metals, for example, sodium, potassium, and the like, can be used for example in the range of about 0.1% to about 1% by weight of the catalyst. Alkaline earths, for example, magnesium, calcium, barium, and the like, can be used, for example, in the range of about 1% to about 10% by weight of the catalyst.

Further, although the instant invention is illustrated in a preferred embodiment in which the feedstock stream to be purified comprises generally $C_5$ to $C_{10}$ hydrocarbons, i.e, the range normally utilized in motor fuels, any suitable contaminated feedstock stream from which it is desirable to remove such contaminants can be used such as, for example, any fluid hydrocarbon stream such as a hydrocarbon oil stream.

According to the instant invention, the preferred adsorbent comprises bauxite because of its effectiveness and low cost. Although a specific trademarked product is described below and in the Examples, the invention is not limited thereto but includes any preparation of bauxite effective for adsorption of contaminants such as surfactants, corrosion inhibitors, and antifoam agents.

The bauxite can be any bauxite effective to adsorb feedstock contaminants such as surfactants, corrosion inhibitors, antifoam agents, and the like. For example, the bauxite can be selected from most any bauxite comprising in the range of about 30 to about 75 percent $Al_2O_3$, in the range of about 2 to about 31 percent $H_2O$, in the range of about 3 to about 25 percent $Fe_2O_3$, in the range of about 2 to about 9 percent $SiO_2$, and in the range of about 1 to about 3 percent $TiO_2$. The bauxite can be, for example, a commercial activated bauxite such as Porocel bauxite and having characteristics such as those set out in Table IV in Example I below.

Generally, the temperature at which a contaminant containing feedstock stream is contacted with the adsorbent in the adsorbent bed is not considered critical and almost any temperature can be used. In practice, however, the temperature at which the bed is operated can be related to the requirements of the overall process of which the contaminant removal according to the instant invention is a part. Pressure is subject to similar considerations and any pressures effective for the overall process of which the contaminant removal is a part can be utilized.

The heating temperature in the adsorbent bed can be broadly in the range of ambient to about 600° F. (320° C.), more preferably in the range of about 150° F. to about 350° F. (about 65° C. to about 177° C.) since this is a useful range for many hydroprocesses.

The pressure at which a contaminant containing feedstock stream will be contacted with the adsorbent in the adsorbent bed is preferably sufficient to insure that the feedstock stream will be in liquid phase or have a minimum amount in vapor phase at the time of contacting the fixed bed adsorbent to insure good contacting. Thus for a NGL stream such as is used in hydrodesulfurization according to a preferred embodiment of the instant invention, the pressure will generally be below about 700 psia (pounds per square inch absolute).

Weight hourly space velocity (WHSV), i.e., pounds feedstock per pound adsorbent per hour can be in the range of about 0.2 to about 20 with a preferred range being from about 1 to about 5 WHSV since this is a normal range for many hydroprocesses.

To further illustrate the present invention, the following Examples are provided.

EXAMPLE I

A series of adsorption runs was made in small laboratory adsorption beds. A natural gas liquids feed containing about 200 ppm (parts per million) of Dow Corning 2000 silicone antifoaming agent in n-heptane was charged to adsorbent beds containing the adsorbent specified in Table I below. Adsorbents tested include: MgO (magnesia or magnesium oxide); attapulgite clay in the form of Millwhite Clay having the characteristics set out below in Table II; montmorillonite clay in the form of a relatively higher acidity clay such as Filtrol 24 and in the form of a relatively lower acidity clay such as Filtrol 71, the montmorillonite clays having the characteristics set out in Table III below; bauxite in the form of Porocel bauxite, having the characteristics set out in Table IV below; and amorphous silicon dioxide in the form of an intermediate density silica gel such as Davison 59 $SiO_2$ having characteristics set out in Table V below as well as in the form of a regular density silica gel such as Sol-Gel 300 having the characteristics set out in Table VI below. Operation of the adsorbent bed was at 200° F. (93° C.), liquid phase, at a WHSV (weight hourly space velocity) of 1. The concentration of silicone in the effluent was determined by an induction coupled plasma spectrometer. Results are presented in Table I below.

Materials employed in these runs are available as follows: Dow Corning 2000 silicone antifoaming agent from Dow Corning Corp., Midland, Mich.; MgO magnesia from Alfa Div., Ventron Corp., Danvers, MA; Filtrol 24 and Filtrol 71 montmorillonite clays from Filtrol Corp., Los Angeles, Ca.; Davison 59 $SiO_2$ from Davison Chemical Div., W. R. Grace & Co., Baltimore Md.; Porocel bauxite from Porocel Corp., Menlo Park, N.J.; and Sol-Gel 300 from Sol-Gel Corp., Pritchard, Ala.

TABLE I

| Concentration of Silicon in Effluent (ppm) | On Stream Time (Days) | | | | | | |
|---|---|---|---|---|---|---|---|
| | MgO | Millwhite Clay | Filtrol 24 | Filtrol 71 | Davison 59 $SiO_2$ | Porocel Bauxite | Sol-Gel 300 $SiO_2$ |
| 0 | 0 | 0 | 0 | 3.0 | 3.0 | 3.0 | |
| 20 | 0.08 | 0.08 | 2.0 | 3.6 | 3.8 | 3.4 | 13.2 |
| 100 | 0.5 | 0.5 | 6.2 | 4.7 | 5.7 | 4.25 | 13.6 |

TABLE II (Millwhite Clay attapulgite)

| | |
|---|---|
| Chemical Composition | |
| $SiO_2$ | 67%[a] |
| $Al_2O_3$ | 13% |
| $Fe_2O_3$ | 4% |
| MgO | 11% |
| CaO | 2% |
| $K_2O$ | 0.6% |
| $Na_2O$ | 0.3% |
| $TiO_2$ | 0.6% |
| Physical Properties | |
| Loss on Ignition | 20% |
| Bulk Density | 0.5 g/ml |
| Pore Volume | 0.6 ml/g |
| Surface Area | 120 $m^2/g$ |

[a]All percentage figures in Table II through Table VI are given as weight percents on a dry weight basis.

TABLE III (Montmorillonite Clays)[a]

| | Filtrol 24 | Filtrol 71 |
|---|---|---|
| Particle Size Analysis by Tyler Standard Sieve | | |
| Through 16 mesh | — | 100% |
| Through 20 mesh | 100% | — |
| Through 30 mesh | — | 98% |
| Through 60 mesh | 5% | 35% |
| Through 200 mesh | — | 1% |
| Free moisture, wt. % | 10% | 15% |
| Free and Combined Moisture, wt. % (Loss at 1700° F.) | 15 (max.) % | 21 (max.) % |
| Bulk Density, lbs/cu ft | 47 lbs/cu ft | 45.0 lbs/cu ft |
| Particle Density | 1.3 | 1.3 |
| Surface Area, $N_2$ Adsorption (Brunauer, Emmett, and Teller Method) $m^2/g$ | 280–300 | 270–290 |
| Acidity (determined by titrating with KOH to phenolphthalein end point) | 12–20 mg KOH/g | 8.0 mg KOH/g |
| pH | — | 3.0 |

[a]A dash indicates that the information was not available.

TABLE IV (Porocel bauxite)

| | |
|---|---|
| Chemical Analysis | |
| Silica, as Silicon dioxide | 15% |
| Aluminum, as $Al_2O_3$ | 80% |
| Iron, as $Fe_2O_3$ | 4% |
| Titanium, as $TiO_2$ | 1.0% |
| Physical Properties | |
| Loss on Ignition | 12% |
| Bulk Density | 6.8 g/ml |
| Pore Volume | 0.26 ml/g |
| Surface Area | 140 $m^2/g$ |

TABLE V (Davison 59 $SiO_2$)

| | |
|---|---|
| Chemical Analysis | |
| Silica, as $SiO_2$ | >99% |
| Physical Properties | |
| Total Volatile (% at 1750° F.) | 3.5 |
| Apparent density (bulk) | 25.0 lbs/$ft^3$ (400 kg/$meter^3$) |
| Surface Area | 340 $m^2/g$ |
| Particle Size | 1.15 cc/g |
| Particle Size (Tyler Sieve) | 3–8 mesh |

TABLE VI (Sol-Gel 300)

| | |
|---|---|
| Chemical Analysis | |
| Silica, as $SiO_2$ | 99.6% minimum |
| Aluminum, as $Al_2O_3$ | 0.15% maximum |
| Sodium, as $Na_2O$ | 0.10% maximum |
| Iron, as $Fe_2O_3$ | 0.05% maximum |
| Calcium, as CaO | 0.05% maximum |
| Trace compounds | 0.05% |
| Physical Properties | |
| Ignition Loss at 960° C. | 6.5% maximum |
| Apparent Density | 37 lb/$ft^3$ (592.7 kg/$m^3$) minimum |
| Surface Area | 760 $m^2/g$ |
| Particle Size (Tyler Sieve) | 8–20 mesh |

In Table I, the On Stream Time indicates the length of time in days required before the concentration of effluent from the bauxite bed exceeded the concentration of silicone indicated in Table I. To illustrate, for example, when bauxite was employed as adsorbent, the concentration of silicone in the effluent from the bauxite bed did not exceed 0 ppm for 3.0 days, did not exceed 20 ppm for 3.7 days and did not exceed 100 ppm for 5.7 days. In general and subject to the limitations discussed below, the larger the On Stream Time figure in days, the more effective the specified adsorbent functioned in the instant runs.

Consideration of the data in Table I shows that MgO and attapulgite clays such as Millwhite Clay were relatively ineffective as adsorbents for silicone oil under the conditions employed.

Acid montmorillonite clays, such as Filtrol 24 or Filtrol 71 were effective and can be used as adsorbents for silicone oils. However the acid montmorillonite clays have an apparent tendency to catalyze decomposition or depolymerization of the adsorbed chemicals, for example, the acid montmorillonite clays appear to break down the silicone oils into smaller molecules which can be redeposited on the HDS catalyst. In this respect, a more acid clay such as Filtrol 24 suffers from greater disadvantages than a less acid clay such as Filtrol 71.

As further indicated in Table I, an intermediate density silicon dioxide adsorbent such as Davison 59 $SiO_2$ is more effective than either of the acid montmorillonite clays tried and can be used effectively as an adsorbent for silicone oil. Further, the redepositing problem expected with the acid montmorillonite clays is not expected with a silicon dioxide adsorbent. However, compared to an adsorbent comprising bauxite, an intermediate density silica gel such as Davison 59 $SiO_2$ is relatively more expensive.

As further indicated in Table I, a bauxite adsorbent is also effective for removing silicone from a contaminated stream. Although bauxite is slightly less effective than either the relatively less acidic acid montmorillonite clays, such as Filtrol 71 or a silicon dioxide adsorbent such as Davison 59 $SiO_2$, it is currently a most preferred adsorbent. Relative to the acid montmorillonite bauxite is preferred because the bauxite adsorbent is not subject to breaking down the silicone oil which can be followed by redeposition on the catalyst. Rather, the bauxite bed appears either to retain the silicon oil or to pass it. Relative to the intermediate density silicon dioxide adsorbents such as Davison 59 $SiO_2$, bauxite has the advantage of relatively higher exchange capacity and the further advantage of relatively less expensive costs. Relative to a silica gel adsorbent such as Sol-Gel 300 $SiO_2$, bauxite although relatively less effective as an adsorbent than regular density silica gel adsorbents has the advantage of greatly reduced costs.

As further indicated in Table I, a regular density silica gel adsorbent such as Sol-Gel 300 $SiO_2$ is also effective but is much more expensive than the adsorbent comprising bauxite according to the instant invention.

EXAMPLE II

A refinery NGL stream, 22,500 bbl/day and comprising $C_5$–$C_{10}$ hydrocarbons, was combined with a 0.5 MM CFD reformer hydrogen stream and passed through a 8′ diameter × 12′ deep bed of 4–8 mesh Porocel bauxite (Porocel Corp., Menlo Park, N.J.) at 190° F. (88° C.) and 250 psig. The stream was not analyzed, but contained an estimated 10 ppm of silicone plus a similar amount of petroleum sulfonate. Treated NGL was then further heated by heat exchange and a process furnace to 480°–550° F. (249°–288° C.), combined with 5.3 MM CFD of reformer hydrogen and passed through a hydrodesulfurization reactor using Nalco NM 502, a nickel molybdenum catalyst. The unit operated for 84 days before excessive pressure (>50 psi) necessitated a shutdown to burn out exchanger and furnace tubes and change out catalyst. In previous similar operation without an adsorption bed, the unit could only be operated about 30–50 days between shutdowns for cleanup.

That which is claimed is:

1. A method of removing feedstock stream contaminants including at least one of petroleum sulfonate and silicone oils from a contaminated feedstock stream comprising contacting said contaminated feedstock stream with an adsorbent comprising bauxite, thereby removing at least a portion of said contaminants from said contaminated feedstock stream.

2. A method as in claim 1 wherein:
said feedstock stream is a petroleum feedstock stream.

3. A method as in claim 1 wherein:
said feedstock stream generally comprises hydrocarbons having from 5 to 10 carbon atoms per molecule.

4. A method as in claim 2 wherein:
said bauxite comprises in the range of abut 30 to about 75 percent $Al_2O_3$, in the range of about 2 to about 31 percent $H_20$, in the range of about 3 to about 25 percent $Fe_2O_3$, in the range of about 2 to about 9 percent $SiO_2$, in the range of about 1 to about 3 percent $TiO_2$.

5. A method as in claim 4 wherein:
said feedstock stream contaminant is silicone oil.

6. A method as in claim 5 wherein:
said contacting with an adsorbent is carried out in a temperature range from ambient temperature to about 600° F.

7. A method as in claim 6 wherein:
said temperature range is about 150° F. to about 350° F.

8. A method as in claim 3, 4, or 5 wherein:
said contacting with an adsorbent is carried out at a weight hourly space velocity of about 0.2 to about 20.

9. A method as in claim 8 wherein:
said weight hourly space velocity is in the range from about 1 to about 5.

10. A method as in claim 4 wherein:
said feedstock stream contaminant comprises petroleum sulfonates.

* * * * *